US008161893B2

(12) United States Patent
Kindellan

(10) Patent No.: US 8,161,893 B2
(45) Date of Patent: Apr. 24, 2012

(54) CORRUGATED PALLET, SUPER CORE, AND PALLET LOCKING METHOD

(76) Inventor: Michael Thomas Kindellan, Centerton, AR (US)

( * ) Notice: Subject to any disclaimer, the term of this patent is extended or adjusted under 35 U.S.C. 154(b) by 201 days.

(21) Appl. No.: 12/505,878

(22) Filed: Jul. 20, 2009

(65) Prior Publication Data

US 2010/0011998 A1 Jan. 21, 2010

Related U.S. Application Data

(60) Provisional application No. 61/081,849, filed on Jul. 18, 2008.

(51) Int. Cl.
*B65D 19/00* (2006.01)

(52) U.S. Cl. ..... 108/51.3; 108/56.1

(58) Field of Classification Search ..... 108/51.3, 108/56.1, 57.33, 56.3; 206/386, 596, 598–600
See application file for complete search history.

(56) References Cited

U.S. PATENT DOCUMENTS

| | | | | | |
|---|---|---|---|---|---|
| 5,285,731 | A * | 2/1994 | McIntyre | 108/51.3 |
| 5,528,994 | A * | 6/1996 | Iseli | 108/51.3 |
| 5,537,937 | A * | 7/1996 | Juvik-Woods | 108/51.3 |
| 5,592,885 | A * | 1/1997 | Young et al. | 108/51.3 |
| 5,934,202 | A * | 8/1999 | Lai | 108/51.3 |
| 6,070,726 | A * | 6/2000 | Graham | 108/56.1 |
| 6,332,535 | B1 * | 12/2001 | Usui et al. | 108/51.3 |
| 6,394,003 | B1 * | 5/2002 | Lacy, III | 108/51.3 |
| 6,698,362 | B2 * | 3/2004 | Crevillen Pastor | 108/51.3 |
| 7,234,402 | B2 * | 6/2007 | Olvey et al. | 108/51.3 |
| 7,426,890 | B2 * | 9/2008 | Olvey | 108/51.3 |
| 2001/0011517 | A1 * | 8/2001 | Brakemann | 108/51.3 |
| 2007/0289504 | A1 * | 12/2007 | Harp et al. | 108/51.3 |

* cited by examiner

*Primary Examiner* — Hanh V Tran

(57) ABSTRACT

A corrugated pallet is provided. The pallet includes a top, a bottom, and first and second pairs of opposing side walls that extend from the top and bottom and, along with the top and bottom, define an interior space of the pallet. A core is provided in the interior space for providing strength to the pallet. Also provided is a novel core for use in a corrugated pallet.

14 Claims, 9 Drawing Sheets

CORRUGATED PALLET, SUPER CORE, AND PALLET LOCKING METHOD

RELATED APPLICATIONS

Figure 1:
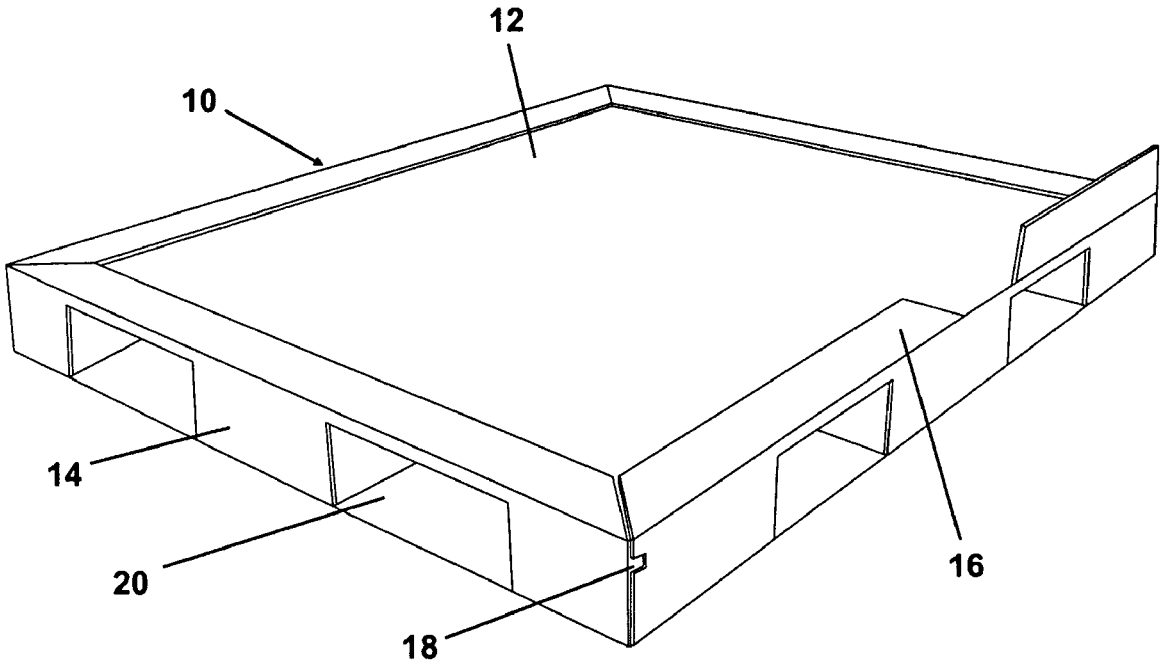

This Application claims priority of U.S. Provisional Application No. 61/081,849, filed Jul. 18, 2008.

BACKGROUND OF THE INVENTION

1. Field of the Invention

The present invention relates generally to a novel pallet, and more specifically to a novel, recyclable corrugated pallet with a novel core, and a pallet locking method.

2. Description of the Prior Art

Wooden pallets are well-known in the art and represent the standard in domestic and foreign pallet use. The use of wooden pallets has, however, a number of disadvantages. Wooden pallets are typically produced from hardwood, a source that is not renewable within a human lifetime. Many hardwood trees take as much as 250 to 500 years to grow to a point where the consumed wood is replaced. Thus, the use of wooden pallets represents a substantial use of limited resources, and is not an environmentally sound use of these resources. Wooden pallets are also heavy and unwieldy, thereby presenting a danger in the workplace.

Corrugated pallets have existed in the art for around 50 years, though they have been produced primarily for the export market rather than for domestic use. Such pallets are typically of poor construction and designed only for a single use—that of supporting exported goods. Existing corrugated pallets will not stand up to side deflection from pallet jacks or forklifts, and often collapse from the weight of product placed thereon. Also, although use of corrugated pallets represents an environmentally-sound alternative to wood, the disadvantages of such pallets have resulted in the failure of the marketplace to adopt their use in any significant number.

What is needed, therefore, is a corrugated pallet that is designed to support heavy loads, resist side deflection, and withstand multiple uses so that it can serve as an effective replacement for the traditional wooden pallet. Further, there is a need for such a pallet that is entirely recyclable and constructed entirely from post-consumer waste.

BRIEF DESCRIPTION OF THE DRAWING FIGURES

FIG. 1 provides a side elevational view of a corrugated pallet constructed in accordance with the teachings of the present invention.

Figure 2:
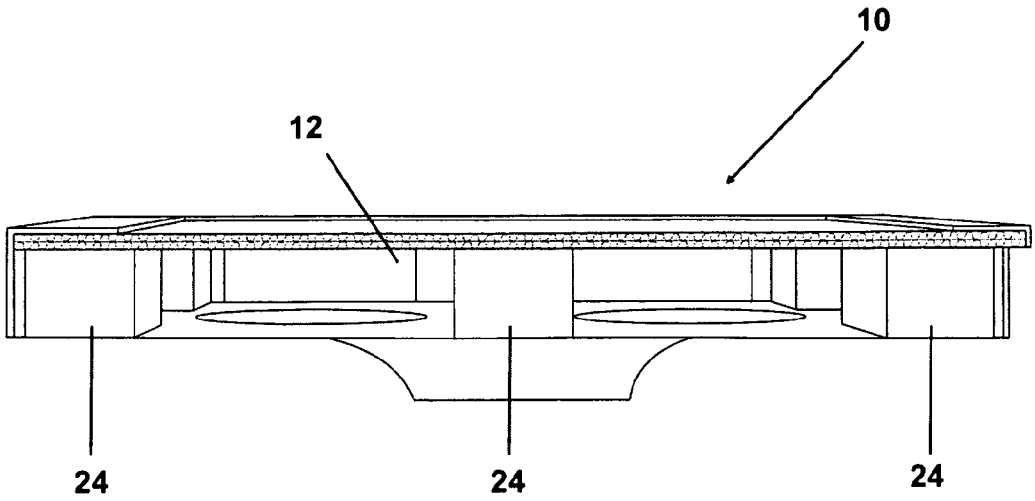

FIG. 2 provides a side view of a corrugated pallet of the present invention showing a portion of the interior thereof.

Figure 3:
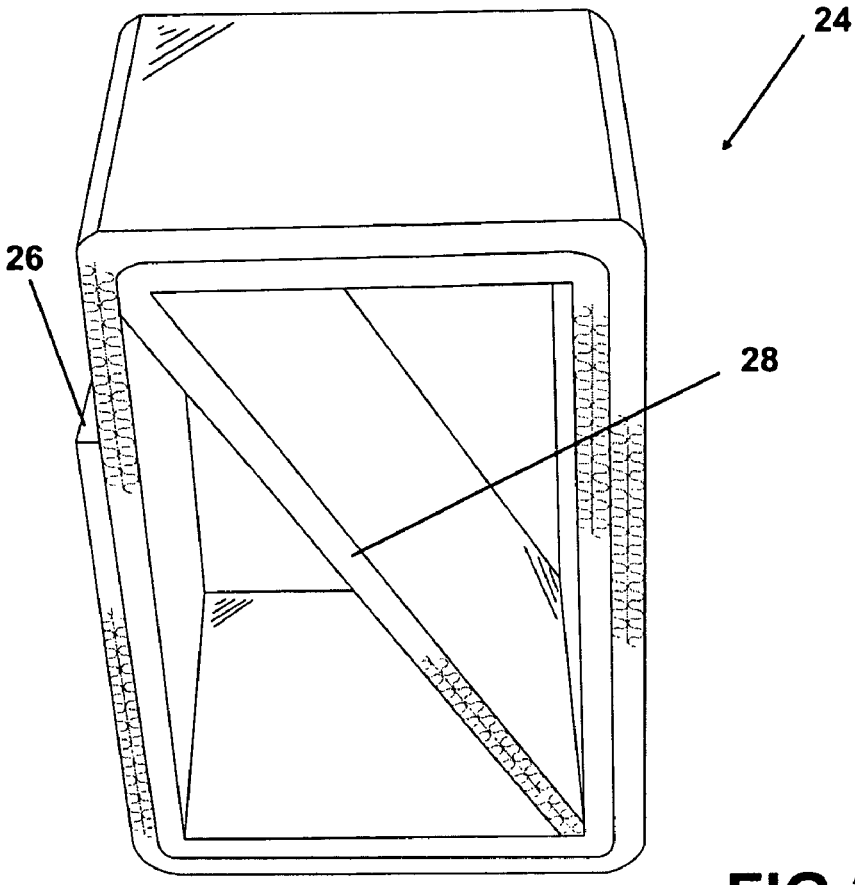

FIG. 3 provides a top view of a core of a corrugated pallet of the present invention.

Figure 4:
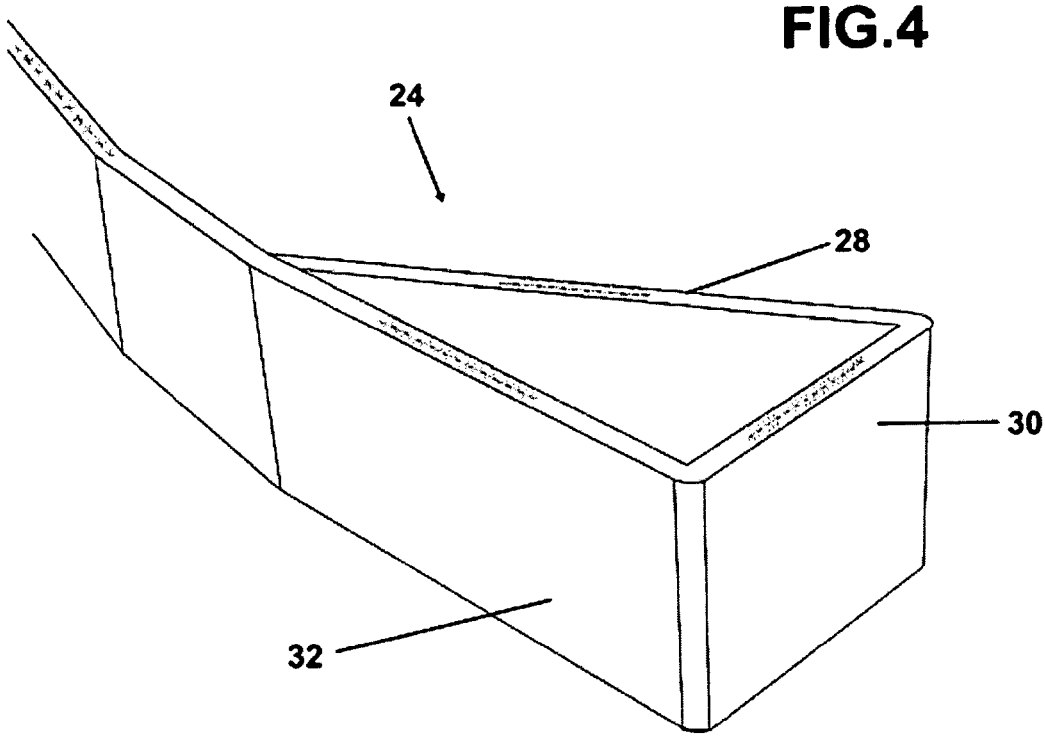

FIG. 4 provides a top view of a partially-completed core of a corrugated pallet of the present invention.

Figure 5:
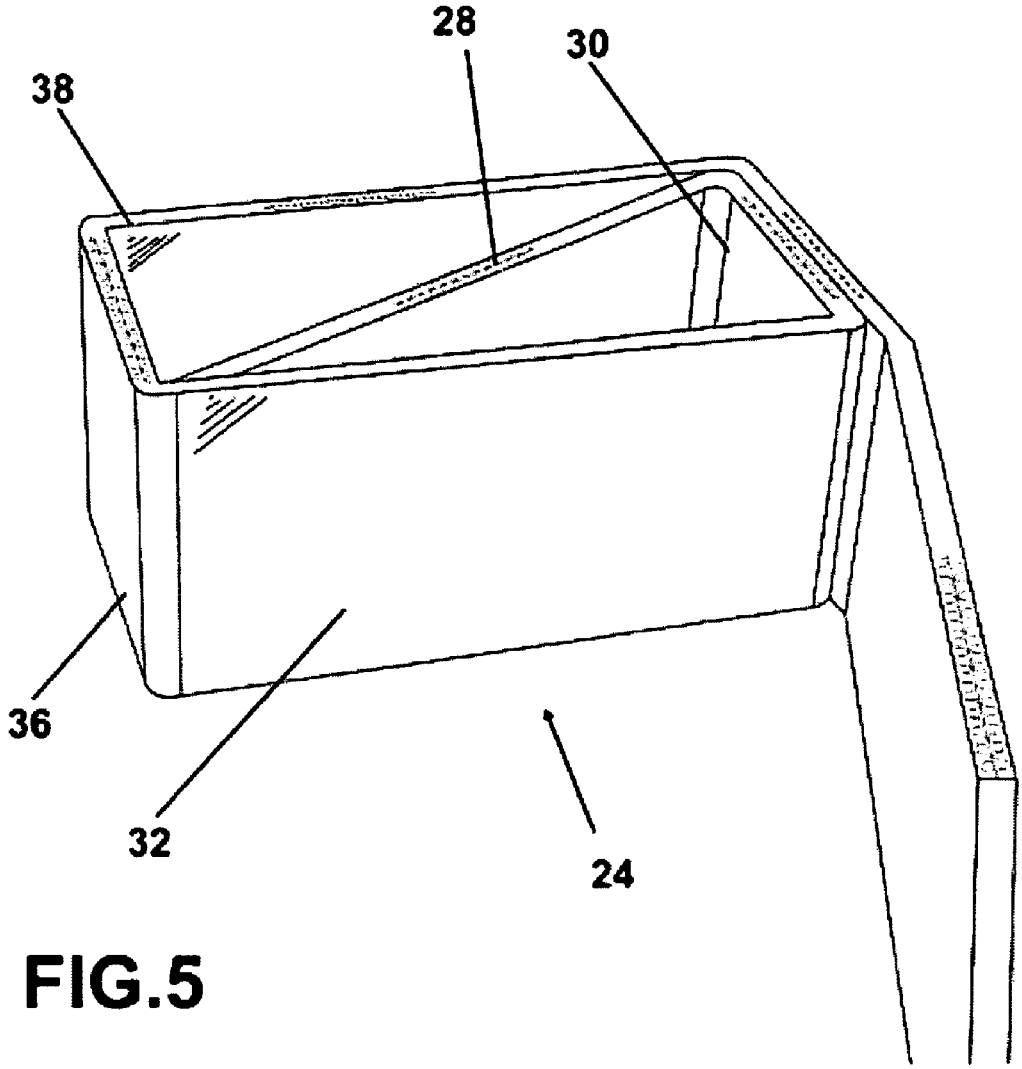

FIG. 5 provides a top view of a partially-completed core of a corrugated pallet of the present invention.

Figure 6:
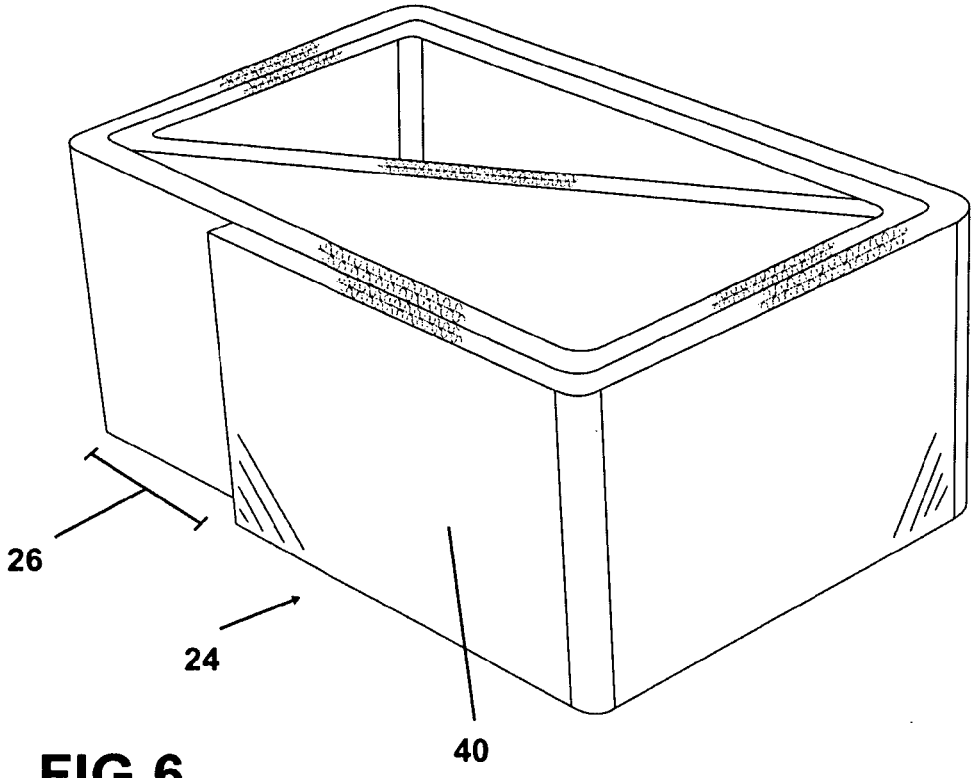

FIG. 6 provides a side elevational view of a completed core of a corrugated pallet of the present invention.

Figure 7:
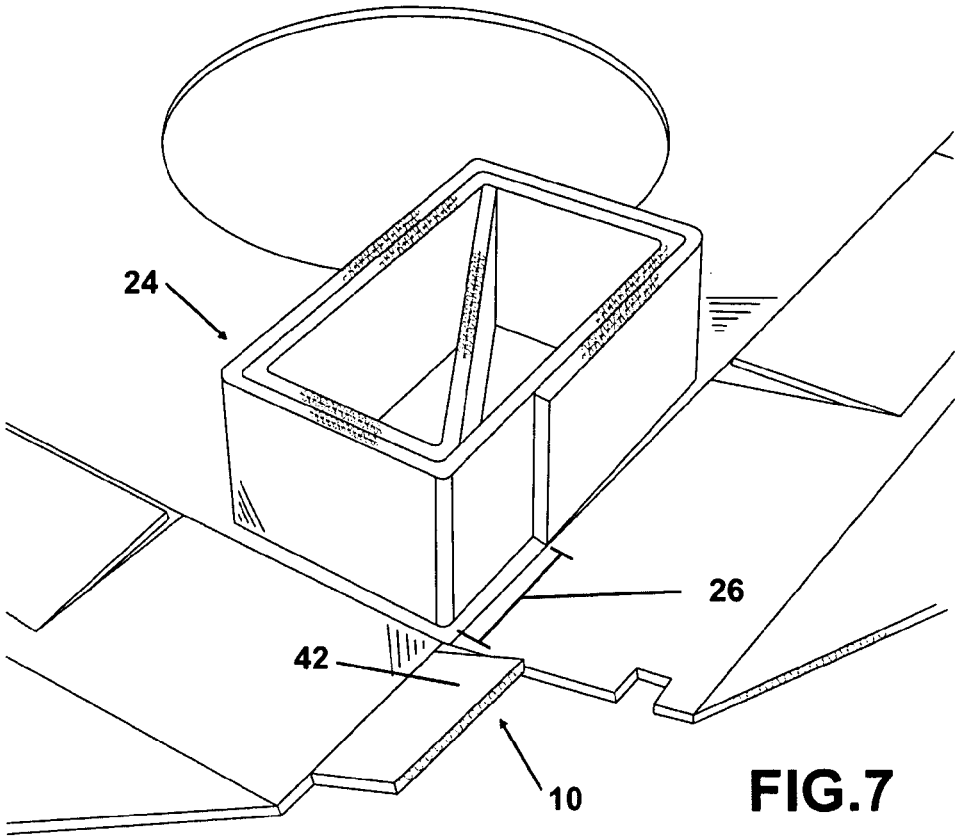

FIG. 7 provides a side elevational view of a core associated with a collapsed corrugated pallet of the present invention.

Figure 8:
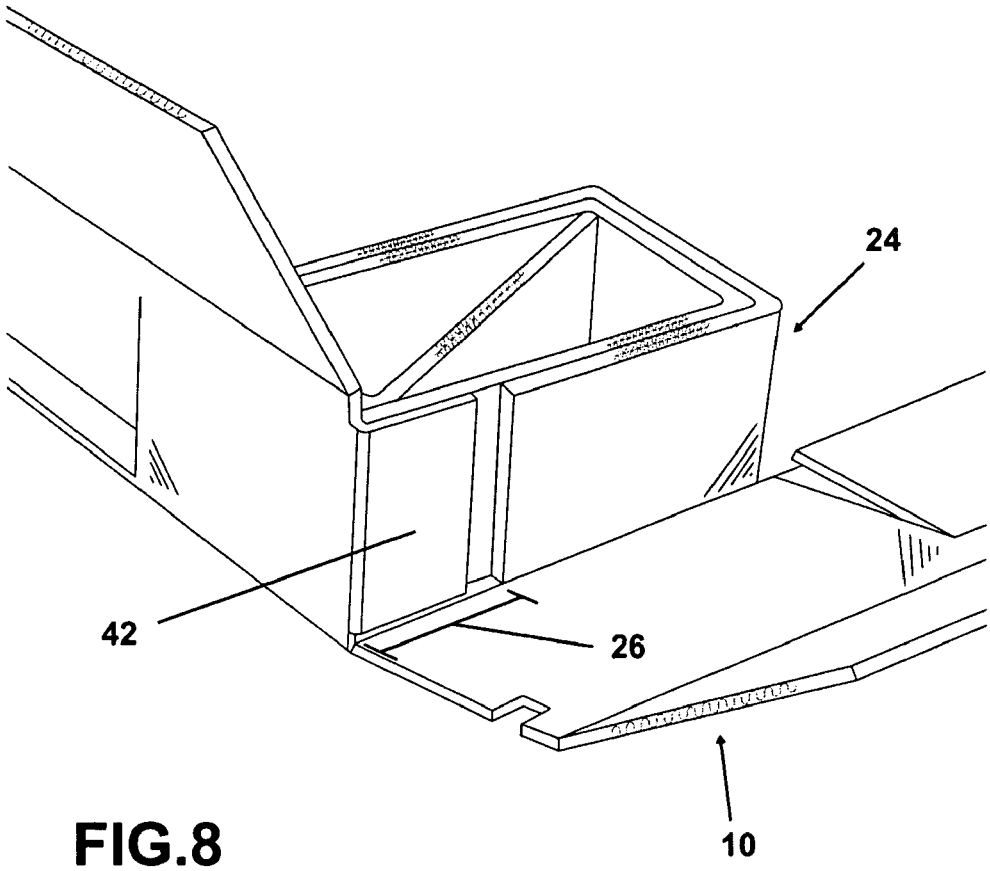

FIG. 8 provides a side elevational view of a core affixed to an interior of a partially-constructed corrugated pallet of the present invention, the affixing of the core to the pallet being according to the present invention.

Figure 9:
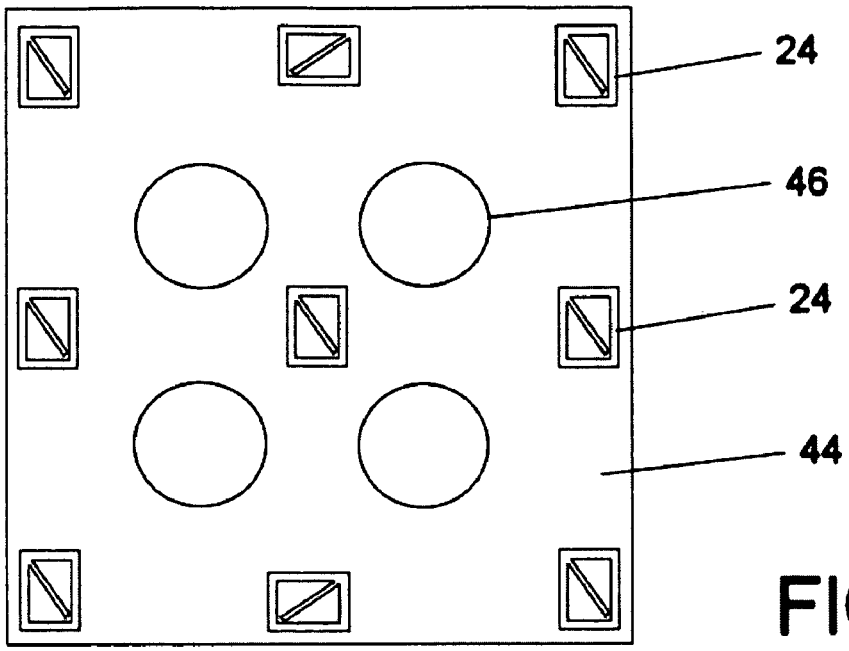

FIG. 9 provides a top cross-sectional view of a corrugated pallet of the present invention.

DETAILED DESCRIPTION OF THE INVENTION

The present invention provides a corrugated pallet capable of supporting a substantial weight and withstanding a substantial amount of force in the form of side deflection. The pallet of the present invention is preferably entirely recyclable and created from 100% post-consumer waste material.

Turning now to the drawings, wherein like numeral indicate like parts, FIG. 1 shows generally a corrugated pallet 10 constructed in accordance with the teachings of the present invention. Corrugated pallet 10 is constructed generally in the shape of a square, much the same as a traditional hardwood pallet, and has an upper surface 12 upon which a load may be placed. Sidewalls 14 are preferably formed, as shown in FIG. 1, from portions of corrugated material that are folded up from the bottom of corrugated pallet 10 to form side walls for the pallet. Sidewalls 14 preferably terminate in supporting flaps 16, which are adapted to fold onto an upper surface of top surface 12. Supporting flaps 16 are preferably adhered to the upper surface of top surface 12 by use of a suitable adhesive.

Further adding to the strength of corrugated pallet 10, and sidewall 14 thereof, are interlocking portions 18 present at each of the four corners of corrugated pallet 10, where individual folds that make up sidewalls 14 come together. Interlocking portions 18 provide greater overall strength to corrugated pallet 10 and allow greater resistance to deflection pressures from pallet jacks and the like.

As can be further seen in FIG. 1, sidewalls 14 of corrugated pallet 10 include openings or pallet jack entries 20. Pallet jack entries 20 are adapted to receive the forks of a pallet jack or forklift so that corrugated pallet 10 can be raised, moved, or otherwise manipulated by the pallet jack or forklift. Pallet jack entries 20 are preferably provided on all four sides of corrugated pallet 10.

FIG. 2 provides a side view of a corrugated pallet 10 constructed in accordance with the teachings of the present invention, sidewalls 14 of corrugated pallet 10 being removed such that a view of cores 24 used within corrugated pallet 10 is provided. Shown in FIG. 2 is top surface 12 of corrugated pallet 10, bottom surface 22 of corrugated pallet 10, and multiple cores 24 spaced therebetween. It is preferred that corrugated pallet 10 include nine cores 24, with one located at each corner, one positioned approximately half way along the length of each side, and one located at approximately the middle of corrugated pallet 10. FIG. 2 does not provide visibility for each of the nine cores 24 used.

FIG. 3 provides a top view of a core 24 constructed in accordance with the teachings of the present invention. As can be seen in the figure, core 24 is produced from a portion of corrugated material with multiples folds, forming a unique shape that provides substantial strength to corrugated pallet 10. A portion of this strength is due to middle cross section 28, which extends across an opening in the middle of core 24. Middle cross section 28 is preferably secured to an inside corner surface of core 24 by use of a suitable adhesive. Core 24 further includes a notch 26 for attachment of core 24 to the body of corrugated pallet 10 and providing further strength thereto. Production of core 24 is detailed below.

FIG. 4 illustrates an unfinished core 24 in early stages of production. A portion of corrugated material used for producing core 24 has been folded twice at this point, defining middle cross section 28, a first inner wall 30 of core 24, and a second inner wall 32 of core 24. The portion of corrugated material extending away from this partially-complete core 24 is used in producing the remainder of core 24.

FIG. 5 shows a partially-complete core 24 having a fully-defined opening in a middle thereof, the opening including middle cross section 28. In addition to inner wall 30 and inner wall 32, as shown in FIG. 4, core 24 shown in FIG. 5 includes inner wall 36, as well as reinforcing wall 38. Reinforcing wall 38 is preferably adhered to a surface of inner wall 30 by use of a suitable adhesive. Further, a suitable adhesive is preferably used to adhere an end of middle cross section 28 to a point at or near the fold between inner wall 32 and inner wall 34. A remaining portion of corrugated material extends away from the partially-complete core 24 shown in FIG. 5, and that material is used in large part for constructing the remainder of core 24.

FIG. 6 provides a side elevational view of a completed core 24, the core being held in place by clamps while the adhesive used in producing the core has time to form a permanent bond. In addition to the inner and reinforcing walls shown in FIG. 5 and described above, a final reinforcing wall 40 is also shown. Reinforcing wall 40 stops short of extending entirely along a side of core 24, leaving a notch 26 for use in attaching core 24 to the corrugated pallet body.

As can be seen from the figures detailing the construction of core 24, core 24 has a number of features that lend it strength and that, in turn, provide great strength to corrugated pallet 10, which uses multiple cores 24. For example, the corrugation flutes in the corrugate material used to construct core 24 extend vertically, providing the core with greater strength. The inner walls of the core complete a box-structure, giving strength to the core. The reinforcing walls provide added weight to the core and increase the strength of the core by providing an increased mass of the corrugated structure. The added layers or walls provided in the core structure also provide increased deflection strength. The corrugated pallet 10 of the present invention can withstand over 5000 pounds of side deflection and 30,000 pounds of static load.

FIG. 7 provides an elevational view of a core 24 positioned on an interior surface of a collapsed corrugated pallet 10. Multiple cores 24 are positioned at appropriate intervals and positioned on an inner surface of collapsed corrugated pallet 10 prior to folding the side walls and flaps of corrugated pallet 10 to form a completed corrugated pallet 10. Further, cores 24 are preferably fixedly attached to an interior surface of corrugated pallet 10 using a suitable adhesive. Core 24 is positioned with notch 26 positioned such that it is ready to mate with a tab 42. Tab 42 extends from a sidewall of corrugated pallet 10 in collapsed form, as shown, and when corrugated pallet 10 is formed by folding the sidewalls and flaps, tab 42 moves into a mating position with respect to notch 26. It is preferred that a suitable adhesive is used to affix tab 42 to notch 26, thereby imparting even greater strength to corrugated pallet 10. FIG. 8 shows a partially assembled corrugated pallet 10 having tab 42 mated with notch 26 of core 24.

FIG. 9 shows a cross-sectional view of a corrugated pallet 10 of the present invention with a top surface removed so that the placement of cores 24 within corrugated pallet 10 can be seen. As shown in the figure, corrugated pallet 10 preferably includes nine cores 24. It is contemplated, however, that a greater or fewer number of cores 24 may be utilized without departing from the spirit or scope of the present invention. Cores 24 are adhered to a bottom surface 44 of corrugated pallet 10 by any suitable method. Also shown in bottom surface 44 are openings 46, which are sized, shaped, and positioned to receive the wheels of a pallet jack when the jack is being used to move or otherwise manipulate corrugated pallet 10.

In addition to the above, other figures are appended to this disclosure but not discussed herein.

The detailed description set forth above is provided to aid those skilled in the art in practicing the present invention. The invention described and claimed herein, however, is not to be limited in scope by the specific embodiments disclosed because these embodiments are intended to be illustrative of several aspects of the invention. Any equivalent embodiments are intended to be within the scope of the present invention. Various modifications of the invention that do not depart from the spirit or scope of the present invention, in addition to those shown and described herein, will become apparent to those skilled in the art from the foregoing description. Such modifications are also intended to fall within the scope of the appended claims.

The invention claimed is:

1. A corrugated pallet comprising:

a top;

a bottom;

a first pair of opposing side walls extending from said top to said bottom and having a foldable tab at an end thereof;

a second pair of opposing side walls extending from said top to said bottom and having a foldable tab at an end thereof;

wherein said top, bottom, first pair of opposing side walls, and second pair of opposing side walls define an interior space of said pallet; and at least one core within said interior space of said pallet, said core comprising at least one wall for structural support of said pallet, wherein said wall forms a substantially closed shape and further wherein said wall is folded such that said core has a thickness of at least two walls along a substantial portion of the perimeter thereof, thereby forming an inner wall and an outer wall, wherein an inner surface of said outer wall contacts an outer surface of said inner wall, wherein said outer wall stops short of extending entirely along a side of said inner wall to provide an exposed outer surface of said inner wall; and a cross section extending from an interior edge of said at least one wall to an opposite interior edge of said at least one wall, wherein the exposed surface of the inner wall of said at least one core mates with the foldable tab of one of said opposing side walls, the foldable tab, when mated with the inner wall of said at least one core, forming a substantially continuous wall with the outer wall of said at least one core.

2. The corrugated pallet according to claim 1 wherein said core has, in operable orientation thereof, an upper surface and a lower surface, said upper surface being fixedly attached to an underside of said top, and said lower surface being attached to an upper side of said bottom.

3. The corrugated pallet according to claim 1 wherein the first and second pair of opposing side walls are formed from a unitary portion of material with one of said top or bottom, said first and second pair of opposing side walls folded to form the side walls of said pallet.

4. The corrugated pallet according to claim 3 wherein said first and second pair of opposing side walls further include supporting flaps formed as unitary portions thereof, said supporting flaps being fixedly attached to the other of said top or bottom.

5. The corrugated pallet according to claim 3 wherein each of said first and second pair of opposing side walls comprises an interlocking portion so that each of said first pair of opposing side walls interlocks with another of said second pair of opposing side walls.

6. The corrugated pallet according to claim 1 comprising five cores within said interior space.

7. The corrugated pallet according to claim 1 comprising nine cores within said interior space.

8. The corrugated pallet according to claim 3 comprising five cores within said interior space.

9. The corrugate pallet according to claim 3 comprising nine cores within said interior space.

10. The corrugated pallet according to claim 8 wherein said pallet is substantially rectangular in shape and wherein each corner of said pallet comprises a single core and further wherein the center of said pallet comprises a single core.

11. The corrugated pallet according to claim 9 wherein said pallet is substantially rectangular in shape and wherein each corner of said pallet comprises a single core and further wherein the center of said pallet comprises a single core, and further wherein a core is positioned along each perimeter edge of said pallet at approximately half way along a length thereof.

12. The corrugated pallet according to claim 2 wherein the bottom of the pallet defines at least one opening for receipt of a wheel of a pallet jack when the pallet jack is being used to move said pallet.

13. A pallet core comprising:

at least one wall for structural support of a pallet, wherein said wall forms a substantially closed shape and further wherein said wall is folded such that said core has a thickness of at least two walls along a substantial portion of the perimeter thereof, thereby forming an inner wall and an outer wall, wherein an inner surface of said outer wall contacts an outer surface of said inner wall, wherein said outer wall stops short of extending entirely along a side of said inner wall to provide an exposed outer surface of said inner wall; and;

a cross section extending from an interior edge of said at least one wall to an opposite interior edge of said at least one wall, wherein the exposed surface of the inner wall of said at least one core is configured for mating with a portion of a pallet in which the at least one core is to be used, the outer wall of said at least one core forming a substantially continuous wall with the portion of the pallet to which said inner wall is mated.

14. The pallet core according to claim 13 wherein said wall and said cross section are constructed from a single, unitary portion of material.

* * * * *